United States Patent [19]

Bauer et al.

[11] Patent Number: 4,868,959

[45] Date of Patent: Sep. 26, 1989

[54] APPARATUS FOR PROCESSING A WARP SHEET OF YARNS

[75] Inventors: Karl Bauer; Michael Hanisch; Erich Lenk, all of Remscheid, Fed. Rep. of Germany

[73] Assignee: Barmag AG, Remscheid, Fed. Rep. of Germany

[21] Appl. No.: 300,226

[22] Filed: Jan. 24, 1989

Related U.S. Application Data

[60] Continuation of Ser. No. 144,496, Jan. 15, 1988, abandoned, which is a division of Ser. No. 912,003, Sep. 26, 1986, Pat. No. 4,814,122, which is a division of Ser. No. 676,722, Nov. 30, 1984, Pat. No. 4,630,340.

[30] Foreign Application Priority Data

Dec. 1, 1983 [DE] Fed. Rep. of Germany ..... 3343499
Feb. 25, 1984 [DE] Fed. Rep. of Germany ..... 3406937

[51] Int. Cl.[4] ..... D02H 13/08; D02J 1/08; D02J 1/22

[52] U.S. Cl. ..... 28/187; 28/242; 432/38; 432/60

[58] Field of Search ..... 28/172, 185, 186, 187, 28/240, 241, 242, 246; 34/49, 124; 432/26, 38, 60, 236

[56] References Cited

U.S. PATENT DOCUMENTS

| | | | |
|---|---|---|---|
| 2,682,144 | 6/1954 | Hare . | |
| 2,767,435 | 10/1956 | Alles . | |
| 3,271,823 | 9/1966 | Whitehurst . | |
| 3,421,193 | 1/1969 | Taylor . | |
| 3,561,081 | 2/1971 | Fehrer . | |
| 3,583,687 | 6/1971 | Minoo et al. . | |
| 3,618,168 | 11/1971 | Mukai et al. . | |
| 3,648,338 | 3/1972 | Mruk . | |
| 3,770,866 | 11/1973 | Sakata et al. . | |
| 3,947,538 | 3/1976 | Marshall et al. . | |
| 4,232,435 | 11/1980 | Eriksen . | |
| 4,407,767 | 10/1983 | Seaborn . | |
| 4,525,905 | 7/1985 | Bogucki-Land . | |
| 4,592,119 | 6/1986 | Bauer et al. | 28/241 X |
| 4,611,410 | 9/1986 | Brossmer | 28/172 X |
| 4,630,213 | 12/1986 | Stagg, Jr. et al. . | |
| 4,630,340 | 12/1986 | Bauer et al. | 28/242 X |
| 4,669,159 | 6/1987 | Bogucki-Land | 28/185 |

FOREIGN PATENT DOCUMENTS

| | | | |
|---|---|---|---|
| 1134575 | 11/1982 | Canada | 28/242 |
| 0047348 | 3/1982 | European Pat. Off. . | |
| 3018373 | 11/1981 | Fed. Rep. of Germany . | |
| 2404066 | 4/1979 | France . | |
| 2444733 | 7/1980 | France . | |
| 608134 | 5/1978 | U.S.S.R. | 28/241 |

*Primary Examiner*—Robert R. Mackey
*Attorney, Agent, or Firm*—Bell, Seltzer, Park & Gibson

[57] ABSTRACT

An apparatus for processing a warp sheet of synthetic multifilament yarns is disclosed, and wherein the yarns may be withdrawn from supply packages and advanced along a path of travel in warp sheet form, heated and drawn while in advancing warp sheet form to orient the filaments, and then wound for example on a warp beam. Upon detection of a yarn break, the advance of the warp sheet is terminated, and means are provided for interrupting the application of heat to the sheet while the advance is terminated so as to avoid damage to the remaining yarns from a continued application of heat.

11 Claims, 4 Drawing Sheets

APPARATUS FOR PROCESSING A WARP SHEET OF YARNS

This is a continuation of application Ser. No. 144,496 filed Jan. 15, 1988, now abandoned, which in turn is a division of application Ser. No. 912,003, filed Sep. 26, 1986, now U.S. Pat. No. 4,814,122, which in turn is a division of application Ser. No. 676,722, filed Nov. 30, 1984, now U.S. Pat. No. 4,630,340.

The present invention relates to an apparatus for processing a warp sheet of synthetic multifilament yarns, and wherein the yarns may be withdrawn from supply packages, beated and drawn while in warp sheet form to orient the filaments, and then wound for example on a warp beam. Up to 1000 or more yarns may be simultaneously processed in this manner.

In the case of a yarn break during processing of a warp sheet in the manner generally described above, it is necessary to immediately terminate the winding operation, so as to prevent further yarn breaks and to avoid having a broken end travel through the apparatus to a point where it can no longer be readily pieced up. A sudden shut down of the apparatus however involves the risk that the remaining unbroken yarns will remain in contact with the heaters of the draw system, and be melted or otherwise damaged, such that they may break upon re-starting of the winding operation.

Heretofore, non-movable heating means such as snubbing pins have been used to stabilize the drawing area by the application of heat and drag to the yarns, which is particularly useful in drawing yarns of polyethyleneterephthalate. Though having the advantage of avoiding overheating of the yarns in the case of a shutdown of the apparatus, such non-movable heating means has been unsatisfactory in the drawing of warp sheets of yarns, since uneven drawing, yarn breakage, and uneven dyeing often occur.

It is accordingly an object of the present invention to provide an apparatus and method of the described type which uses heated rolls rather than non-movable heaters for stabilizing the drawing area in the undrawn yarn, and which effectively avoids the problem of having any of the yarns damaged by overheating during termination of the advance of the warp sheet upon a yarn break, or when the apparatus is otherwise shut down.

These and other objects and advantages of the present invention are achieved in the embodiments illustrated herein by the provision of an apparatus which includes means for advancing the warp sheet along a path of travel while drawing the sheet, heating means positioned along the path of travel for applying heat to the advancing warp sheet, and control means for terminating the advance of the warp sheet upon a yarn break or the like, i.e., any other event causing the apparatus to be shut down, and for interrupting the application of heat to the warp sheet by the heating means upon the termination of the advance, and for re-establishing the application of heat upon the re-starting of the advance.

In one preferred embodiment, the heating means comprises at least one heated roll, and the control means, comprises means for selectively moving the roll into and out of contact with the warp sheet. More particularly, in this embodiment the heating means preferably comprises a pair of rolls mounted at the ends of a pivotal lever arm and such that one of the rolls is positioned above the warp sheet and the other of the rolls is positioned below the warp sheet. The lever arm may be pivoted to a first position wherein the rolls are adapted to deflect the path of travel of the advancing warp sheet into an S or Z configuration. Also, the lever arm may be pivoted to a non-operative second position wherein the rolls are substantially out of contact with the warp sheet.

The apparatus of the present invention also includes tension controlling means for maintaining the overall tension in the warp sheet substantially uniform during movement of the heated rolls between the above described first and second positions. In one preferred embodiment, this tension controlling means comprises a pair of unheated rolls, and which are positioned within the drawing zone. The unheated pair of rolls are similar in construction to the heated rolls, and both pairs of rolls cooperate in such a manner that the heated pair of rolls contacts the sheet while advancing, and the unheated pair contacts the sheet while it is stopped. The movements are coordinated such that the pair of rolls moving into contact with the warp sheet compensates for a release in tension resulting from the other pair moving out of contact with the sheet. By coordinating the movement of the two pairs of rolls to the momentary speed of the sheet, and such that the heated rolls move fully into contact only when the maximum advancing speed has been reached and that they otherwise take corresponding intermediate positions, it is possible to insure that an appropriate supply of heat is provided which is adapted to any operational stage. The unheated rolls, may if desired by actively cooled.

In the above embodiment, each of the two pairs of rolls are preferably mounted on respective lever arms, and the lever arms are adapted to pivot about an axis which extends across the warp sheet and generally parallel to the axes of the heated rolls. Also, the lever arms are adapted to pivot an at angle of between about 30 degrees to not more than 180 degrees. Such pivotal movements of the two pairs of rolls are coupled to each other, and with the lever arms arranged parallel to each other, the rotational directions of the arms would be oppositely directed. Where the lever arms are arranged in mirror symmetry, they would rotate in the same direction. Such rotation may be actuated by the control for braking and re-starting the advance of the warp sheet.

The nature of the pivoting movement of the two pairs of rolls is preferably controlled so that a change in tension is substantially avoided during a change of the engagement between the pairs of rolls with respect to the warp sheet.

In the case of large drawing systems, in which for example 1000 multifilament yarns or more are being processed, a further embodiment of the invention may be employed wherein the heated rolls themselves are not moved, which often involve substantial mass. In this further embodiment, the sheet of yarns itself performs the necessary relative movement for being removed from the heated roll or other heated member. For this purpose, a lifting cover is associated with each heated roll, with each roll being mounted for rotation about a stationary axis. The cover is adapted to move between the periphery of the roll and the sheet of yarns when the machine is stopped, to thereby separate and shield the sheet from the heat of the roll.

The cover for each of the rolls preferably has an arcuate curvature in cross section, i.e. in the circumferential direction, which is similar to the curvature of the outer periphery of the associated roll, and each cover also has an angular extent which is greater than the looping angle of the warp sheet about the roll. For example, the angular extent of the cover is preferably about 4 to 20 percent greater than the looping angle about the roll.

The lifting cover may be mounted for rotation about the axis of the heated roll itself, or it may be mounted eccentrically thereto. When the lifting cover is in its neutral or inoperative position, the sheet of yarns is adapted to partially loop the heated roll. When the draw system is stopped, the lifting cover is then pivoted, preferably in the running direction of the sheet, so that it comes between the sheet and the roll and lifts the sheet from the roll and holds it spaced therefrom while the sheet is immobile. Upon the advancing of the sheet being re-started, the lifting cover is further pivoted until it is separated from contact with the sheet and again reaches its neutral or inoperative position.

The pivoting motion of the lifting cover is initiated by its own drive, which is actuated when the sheet of yarns is slowed down. The point in time at which the drive starts to operate may be related to the braking retardation of the advancing system, so that the sheet of yarns itself moves the lifting cover to its operative position, where it stops. As soon as the advancing system restarts, the sheet of yarn automatically moves the lifting cover from its operative position back to its neutral or inoperative position. By this arrangement, the self contained drive of the lifting cover may be limited so that it is only necessary to bring the cover into contact with the sheet while it is still advancing, but has slowed down to a predetermined extent. The lifting cover also has the advantage that the sheet of yarns may be held during a shut down under a nearly unchanged tension, to thereby avoid the risk of the yarns entangling.

The pivoting axis of the lifting cover may be eccentric to the axis of the associated roll, and located in a plane which is defined by the axis of the roll and the bisector of the looping angle. Thus while the sheet of yarns is advancing, the lifting cover is removed a relatively substantial distance from the heated surface of the roll, so that it may remain cool. When pivoted to its lifting or operative position, the cover reaches a position in which it is only slightly spaced from the surface of the roll, to minimize the deflection of the yarn sheet and thereby cause a minimal increase of the tension in the yarns.

The minimum distance between the roll surface and the inner surface of the lifting cover in the lifting position, should, depending on the overall dimensions of the roll, typically amount to about 0.5 to 2 mm. In the non-operative position, such distance may be about 10 to 15 mm. The latter separation helps insure that the lifting cover does not unduly heat in its inoperative position, and this objective may be assisted by constructing the lifting cover from a heat insulating material. For example, the cover may comprise a reflective inner layer, an insulating intermediate layer, and a wear resistant outer layer which contacts the warp sheet. The edges of the cover which extend transversely to the warp sheet may be suitable formed of a wear resistant material, since the edges must withstand the relatively high relative movement of the yarns at their first contact with the sheet. In another embodiment, such lifting covers may be used for separating the warp sheet of yarns from a heated plate disposed between two guide rolls.

A mechanically simple and reliably operating embodiment comprises a cover of a flexible sheet of material, the width of which corresponds to the length of the working area of the roller, and the length of which corresponds to at least the braking distance. Braking distance is here defined as the distance through which one point of yarn runs between the setting into operation of the brakes and reaching the standstill of the apparatus. The flexible sheet of material preferably has sufficient insulating properties. In case of yarn breakage and application of the brakes, the sheet of material is moved with its broad leading edge into the nip between the surface of the roller and the warp running onto that surface. The cover is then clamped between the warp and the surface and transported until the roll stops. Upon restarting the apparatus, the sheet of material is transported out of the clamping zone and falls down without further impeding the warp. One can see that the length of the insulating sheet of material should essentially be limited to the braking distance, so that the heating of the warp may restart at the first possible moment. The particular advantage of this embodiment is that the flexible sheet of material does not cause any appreciable increase of yarn tension, and it can withstand the forces exerted by the yarn tension by itself. The drive of this kind of cover is very simple and the moved masses are very small.

A further advantageous embodiment of the present invention provides for a heating means which comprises a heated roll, guide plate, or the like which has a hollow interior, and which is connected to a fluid circulation system whereby a heated fluid may be circulated through the interior of the heated member. In this embodiment, the heating fluid is heated by a suitable external heater, and the circulation system may include a parallel circuit which contains a cooling system, or a source of relatively cool fluid. For example, a cooled container may be provided which contains sufficient quantity of fluid so as to at least effect a partial filling of the circulation system to thereby lower the temperature of the fluid so that the risk of damage to the yarns is avoided. The circulation system preferably also contains valve means which are connected to a yarn monitoring system, either directly of via the machine drive, with the valve means being adapted to switch the fluid circulation from the heating branch, which includes the heating means, to the cooling branch, when a yarn break occurs or the machine is stopped. The advantage of this embodiment of the invention resides in the fact that no mechanical parts are moved when the heating effect is terminated. Such motion of mechanical parts is undesirable in that it may also give rise to substantial vibrations in the machine, and may also lead to changes of the tension being imparted on the sheet of yarns, which in turn may cause the yarns to entangle.

Depending on the operating temperature of the heating means on the one hand, and the temperature of the cooled fluid in the cooling system on the other hand, it is usually sufficient to fill the circulation system with the cool fluid one time. However, to provide further cooling, a circulation of actively cooled heating fluid may be provided. If for example, the heating means serves to set the draw point in polyester yarns, its temperature will be about 100 degrees C. In such instance, a decrease of 20 to 30 degrees will suffice to preclude damage to the yarn, even after a long period of contact. The valve means for the above described fluid conduit system preferably comprises three-way valves which preceed and follow the heater and cool fluid source, respectively.

It is known that in drawing a synthetic filament yarn, and in particular a polyester or polyethyleneterephthalate yarn, a lengthening occurs in a narrowly limited range in the longitudinal direction. The length of this range depends on the spun orientation of the yarn. In yarns with little spun orientation, a flow length of only a few millimeters will develop. In yarns having a greater spun orientation, flow zones of a greater length will form. In each case, the change in length only occurs after the yarn has traveled over the heating means, be it a roll, heated pin, or a hot plate. In accordance with the object of the present invention, namely to avoid contact between the undrawn portions of the yarn and the heating means during termination of the yarn advance, a further embodiment involves a method wherein the feed and draw systems are brought to a standstill upon a yarn break, and then the sheet is advanced in the reverse direction for a predetermined distance wherein any undrawn yarn is returned to a position upstream of the heated surface. As a result, only a drawn yarn length will contact the heating means when the warp sheet is at a standstill, which is behind the flow zone in the traveling direction of the yarn. Thus, following the termination of the yarn advance, an unduly long period of contact between the undrawn yarns and the heater is avoided, since a drawn portion of the yarn is returned to the contact area of the heater. Drawn yarn lengths are adapted to withstand the temperatures normally required for drawing, without damage for a longer period of time, an in particular, for a time normally adequate to eliminate the cause of the breakdown. For example, it has been found that drawn yarn lengths which have contacted the heater for a relatively long period of time, showed no significant differences in dye ability.

The above embodiment of the invention has the particular advantage that the heating means, such as a heated roll, can remain stationary, and that changes of the yarn tension are avoided. It should also be noted that the above embodiment may also be used in association with the other above described embodiments of the invention, should it be found that the sheet of yarns is still unduly exposed to high temperatures which the yarn in its undrawn state cannot withstand without risk of damage. Some of the objects and advantages of the invention having been stated, other objects and advantages will appear as the description proceeds, when considered in conjunction with the accompanying schematic drawings, in which FIG. 1A is a side elevation view of one embodiment of the present invention, shown while the warp sheet is advancing, and which involves a pair of heated rolls and coordinated pair of unheated rolls;

Figure 1A:
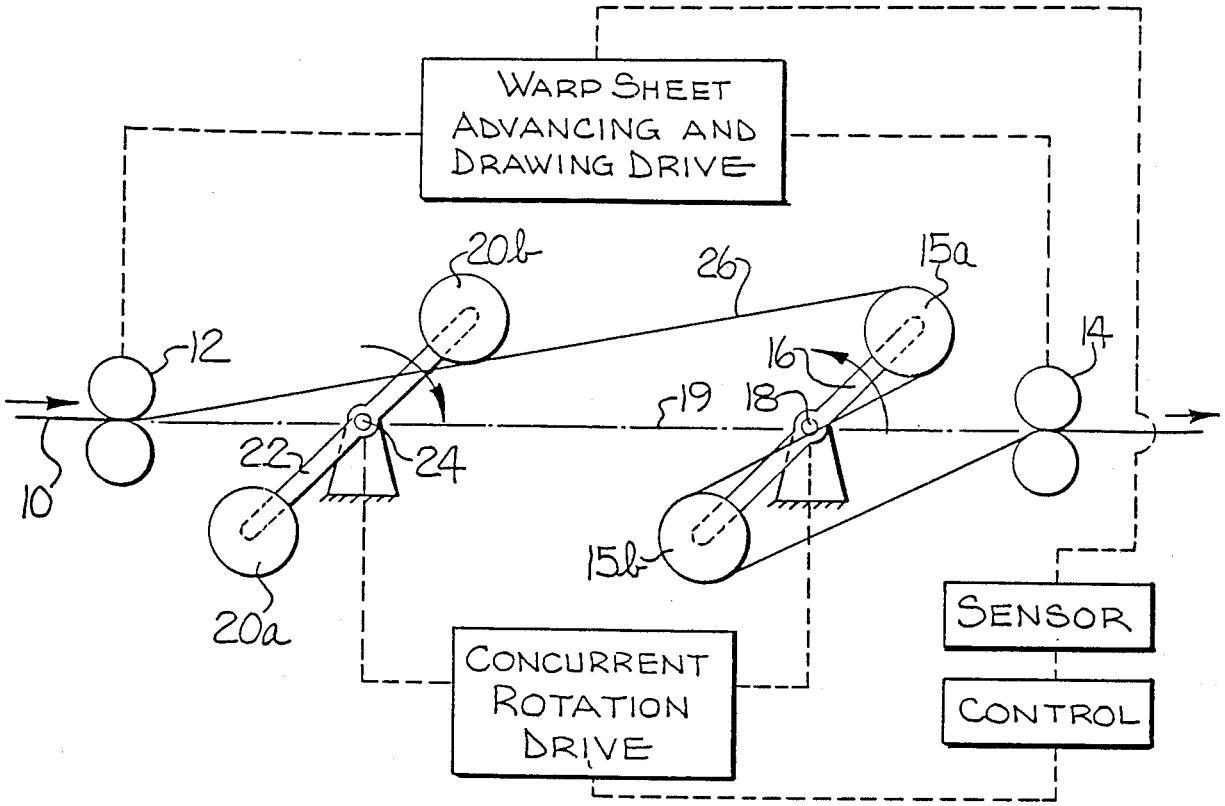
FIG. 1B is a view similar to FIG. 1A, but illustrating the two pairs of rolls in their position when the advance of the warp sheet is terminated.
Figure 1B:
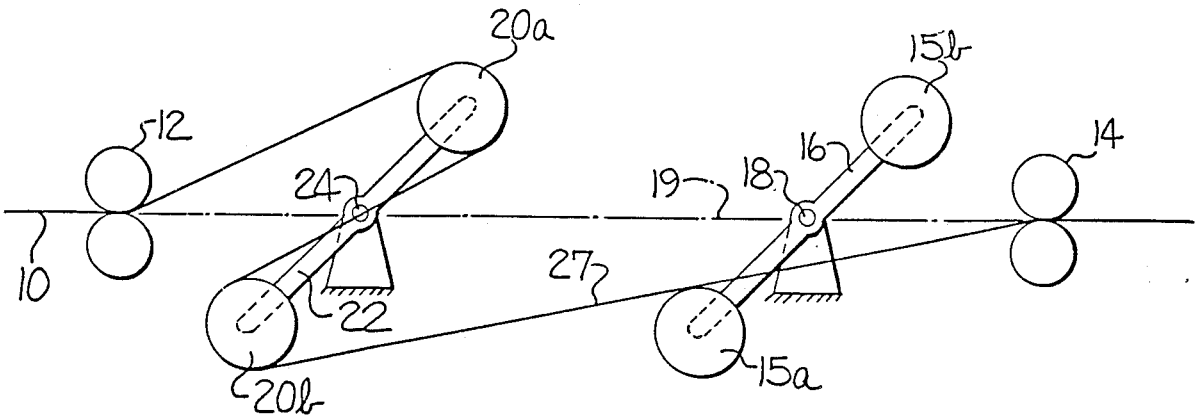

Referring more particularly to the drawings, FIG. 1A and 1B schematically illustrate a preferred embodiment of an apparatus in accordance with the present invention. In this embodiment, the apparatus is adapted to process a warp sheet 10 of yarns, and it comprises an upstream pair of delivery rolls 12 and a downstream pair of delivery rolls 14, which serve to advance the warp sheet 10 along a horizontal path of travel, while drawing the warp sheet. Heating means is positioned along the path of travel for applying heat to the advancing sheet, and the heating means comprises two heated rolls **15*a* and 15*b* which extend transversely across the warp sheet and are arranged parallel to each other. The two rolls 15*a*, 15*b* are rotatably mounted on a lever arm 16, which is adapted to pivot about an axis 18 which extends transversely across the sheet 10 and parallel to the rotational axes of the rolls 15*a*, 15*b*. As illustrated, the axis 18 lies in the plane defined by the two rotational axes of the rolls 15*a*, 15*b*, and it also lies in the plane 19 defined between the pairs of delivery rolls 12 and 14**.

In addition to the pair of heated rolls **15*a*, 15*b*, there is also provided tension controlling means in the form of an unheated pair of rolls 20*a*, 20*b* which are of like design. In particular, the pair of rolls 20*a*, 20*b* are mounted at the ends of a second lever arm 22 which is adapted to pivot about an axis 24 which is parallel to the axis 18 of the arm 16. Both pairs of rolls 15*a*, 15*b*, and 20*a*, 20*b* are positioned in the draw zone between the delivery rolls 12 and 14. The lever arms 16 and 22** extend parallel to each other as illustrated, or they may be arranged in mirror symmetry with respect to each other.

As indicated above, the pivot axes 18 and 24 of the two lever arms preferably lie in the plane defined between the two pairs of delivery rolls 12 and 14. This arrangement permits one of the rolls of each pair to be positioned above the warp sheet 10, and the other roll of each pair to be positioned below the sheet. Thus one roll of each pair is adapted to move into the sheet of yarns 10 from the bottom, and the other roll moves into the sheet from the top. During advance of the sheet, the heated pair of rolls **15*a*, 15*b* assumes the position illustrated in FIG. 1A so as to deflect the sheet 10 along a generally Z-shaped path 26. The unheated rolls 20*a*, 20*b* are then essentially out of contact with the sheet. When the sheet is slowed down, the pivoting movement of both pairs of rolls is initiated in the indicated direction, preferably concurrently with the start of braking. In so doing, the heated pair 15*a*, 15*b* is withdrawn from the sheet of yarns and the unheated pair 20*a*, 20*b* moves into engagement with the sheet so that the path of the sheet becomes changed to that indicated at 27 in FIG. 1B. Both paths 26 and 27 have the same length, so that the sheet of yarns remains under the same tension in both conditions. Advantageously, this operation is controlled as a function of the tension on the sheet of yarns, and so that the tension does not substantially change during movement of the two pairs of rolls. With a parallel arrangement of the lever arms 16 and 22** as illustrated, the arms will be seen to move in opposite directions. However, when the arms are arranged in mirror symmetry, their movement would be in the same direction. Suitable drive means, as schematically illustrated in FIG. 1A, is provided for effecting concurrent pivotal movement of the two pairs of rolls from the position of FIG. 1A to the position of FIG. 1B, and vice versa.

Rather than mounting the rolls 15*a*, 15*b*, and 20*a*, 20*b* to pivotal lever arms as illustrated in FIG. 1, the rolls may alternatively be arranged independently of each other. For example, one heated and one unheated roll may be located below the sheet, and the other heated and unheated roll may be mounted above the sheet. However, in such an arrangement, separate guiding and operating mechanisms are required for each of the rolls, which is more complicated than the above described embodiment. Nonetheless, the separate guidance and control of the rolls may be desirable in that it enables a very sensitive control of the yarn heating, by the extent of the entry of the rolls into the sheet, and whereby the respective looping angles may be changed.

In the above described embodiments, the various rolls represent relatively large masses which must be moved rapidly by reason of the normally rapid braking of the advance of the sheet. This can lead to substantial inertial forces being generated when the rolls are moved. This problem is avoided by another embodiment of the invention, in which the heating means is not moved, but rather, the sheet of yarns is separated from the heating means to thereby interrupt the heating of the sheet of yarns. One embodiment of this design is illustrated in conjunction with FIGS. 2–5.

Figure 2:
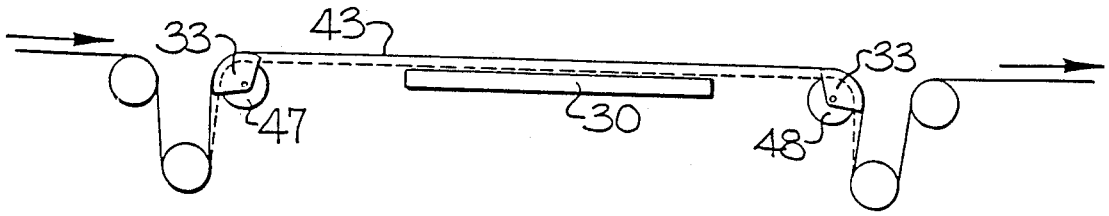
FIG. 2 is a side elevation view of a feeding and drawing system for a warp sheet of yarns, and which incorporates lifting covers on the innermost rolls of the feed system and in accordance with another embodiment of the invention.

In FIG. 2, there is illustrated an arrangement in which a hot plate 30 is mounted at a fixed location below the sheet of yarns 43. The upstream and downstream yarn delivery systems for the sheet of yarns each comprises a series of three rolls about which the sheet is threaded. The innermost rolls 47, 48 of the two delivery systems and which are closest to the hot plate 30 are heated, and each such roll includes a lifting cover 33 which is adapted to move between the sheet of yarns and the associated roll upon the slowing of the advance of the sheet. The covers 33 on the rolls 47, 48 thereby act to lift the sheet from the surface of the hot plate 30, and from the surfaces of the rolls 47, 48, as illustrated in dashed lines, to the solid line position. Thus the heating effect on the sheet is rendered negligible.

Figure 3:
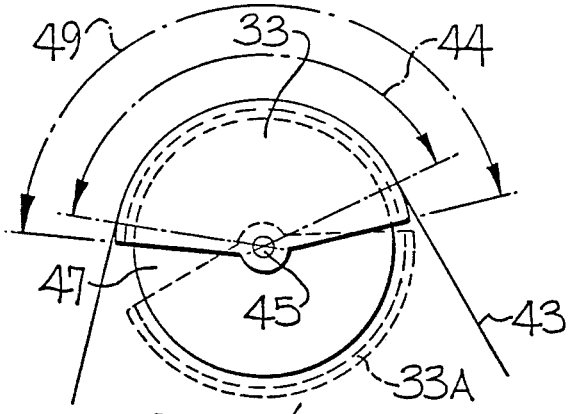
FIG. 3 is an enlarged view of one of the feed rolls and associated cover of the embodiment shown in FIG. 2.
Figure 4:
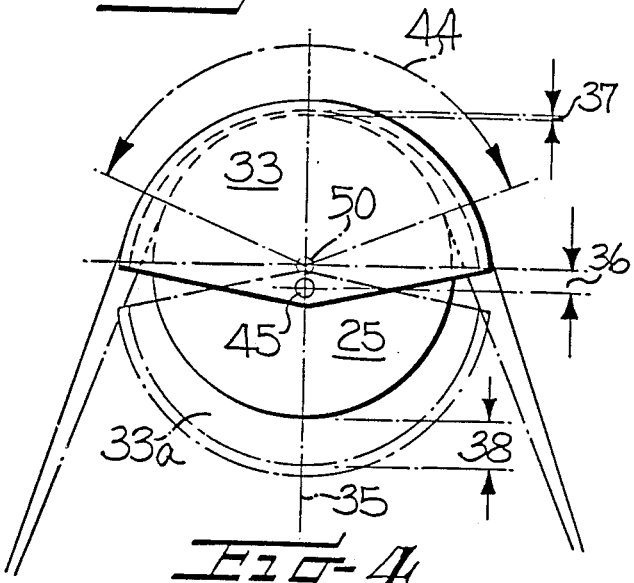
FIG. 4 is a view similar to FIG. 3 but illustrating a second embodiment of the feed roll and cover.

FIGS. 3 and 4 illustrate two different embodiments of a lifting cover 33 for the heated rolls 47, 48 as shown in FIG. 2. In the embodiment of FIG. 3, the pivoting axis 45 of the cover 33 coincides with the axis of the roll 47, so that the lifting cover is spaced a uniform distance from the roll surface during its movement. As illustrated, the angular extent 49 of the area covered by the lifting cover 33 extends beyond the looping angle 44 of the sheet of yarns 43 on the heated roll. As shown in solid lines, the cover 33 is in its operative position between the sheet of yarns 43 and the roll surface, and it is adapted to shield the sheet from the underlying roll. When the sheet of yarns is advancing, the lifting cover 33 is in the inoperative position 33A, shown in dashed lines. The area to be covered by the lifting cover 33 depends upon the respective looping angle 44, and if possible, the area 49 should be four to twenty percent larger than the looping angle 44. This of course is only possible when the looping angle 44 is less than 180 degrees, which is the normal case.

FIG. 4 illustrates an embodiment which may be used in the case of a cantilevered heating roll. In this embodiment, the axis of rotation 45 of the lifting cover 33 is located spaced from and parallel to the axis 50 of the roll a distance 36. The axis 45 is also arranged in a plane 35 which is defined by the roll axis 50 and the bisector of the looping angle 44. This arrangement is advantageous in that the distance 37 between the roll surface and the inside of the lifting cover 33 is smaller in the lifting or operating position, than is the distance 38 in its inoperative position 33A. As a typical example, the minimum distance 37, which is also a function of the relative size of the apparatus, measures bout 0.5 to 2 mm in the operating position, and the distance 38 measures about 10 to 25 mm in the inoperative position.

Figure 5:
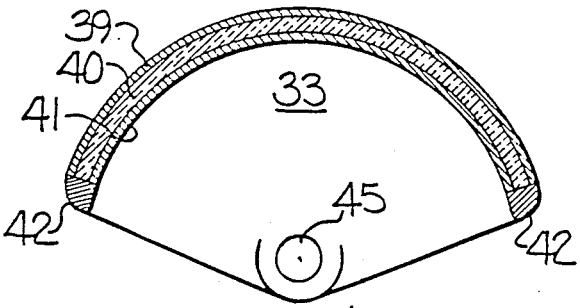
FIG. 5 is a fragmentary sectional view of the cover shown in FIG. 4.

In instances where the rolls 47, 48 are heated, the effect of the lifting cover 33 will be aided when it is composed of a heat insulating material, as is shown in FIG. 5. In this embodiment, the cover 33 is composed of an inner reflective layer 41, an insulating intermediate layer 40, and a wear resistant yarn contact layer 39. The edges 42 extending transversely to the sheet are preferably composed of a wear resistant material.

In some cases, it may be desirable to cool the rolls of the downstream delivery system 14, so as to avoid possible changes in the yarn structure caused by the heat, such as an uncontrolled subsequent condensation. Also, the preheating of the sheet of yarns 43 as it enters the draw zone may be advantageous. To be able to closely control the heating of the sheet, there is also provided the possibility of adapting the effect of the heat on the sheet to the momentary speed of the sheet. This may be accomplished by a change of the effective looping angle 44, or the partial covering of the heated roll by the cover 33. In the embodiment of FIG. 1, the above object may be accomplished by coordinating the pivoting of the two pairs of rolls 15*a*, 15*b*, and 20*a*, 20*b* since the looping angle may be substantially varied as a function of the depth of entry of the rolls into the sheet, between a minimal surface contact to a maximum looping.

Figure 6:
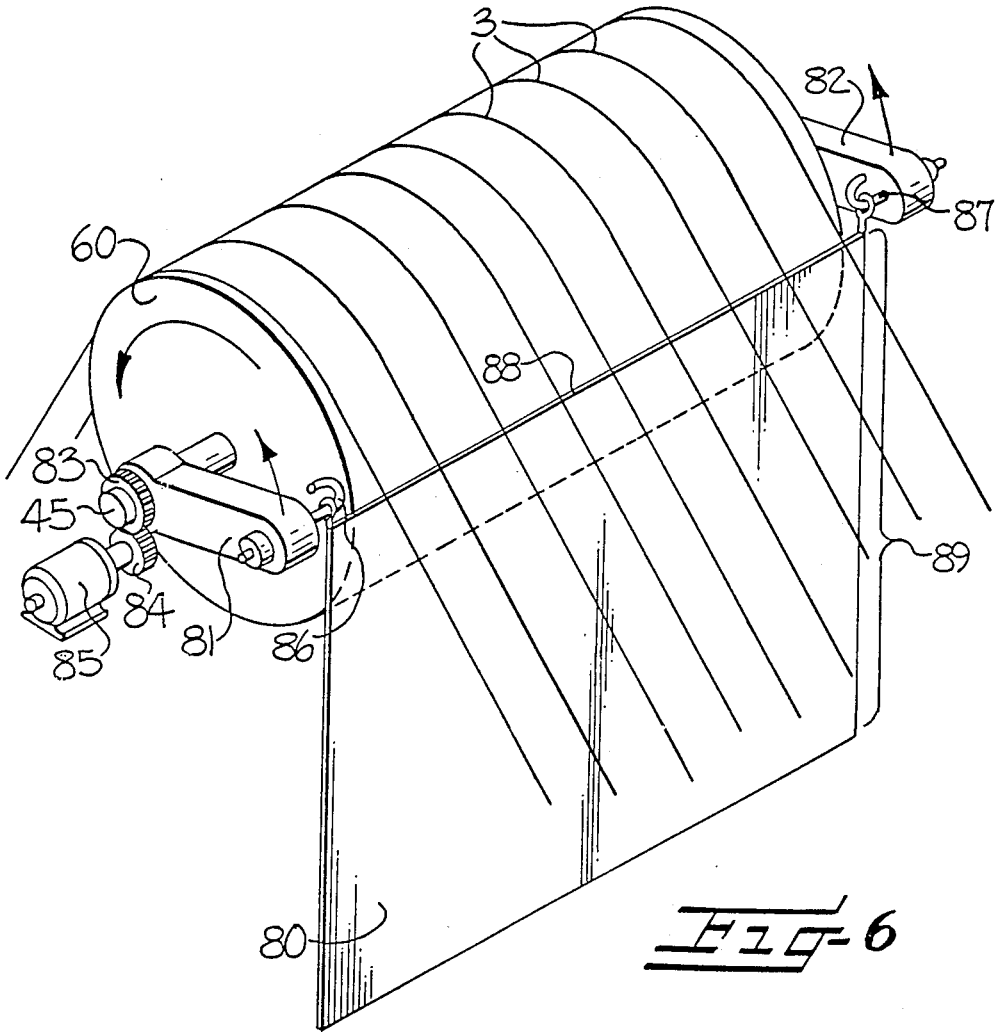
FIG. 6 is a perspective view of an embodiment wherein the cover comprises a flexible sheet material.

FIG. 6 illustrates a further embodiment of the invention. In this embodiment, the cover is a flexible sheet 80 of material. There is shown one heated roll 60 which is rotatably supported in bearings (not shown) and driven by a drive (not shown). The roll 60 is partly wrapped by the yarns 3 which form a warp. A lever arm 81 or 82 is freely rotatably mounted to the axis 45 of the roll at respective ends thereof. Each lever arm is connected to a gear wheel 83, which is driven via the gear wheel 84 and motor 85. It should be noted that a gear wheel identical with 84 and a motor identical with 85 are provided at the other end of the roll. Both motors are synchronously driven in the same direction of rotation as is roll 60. In case of yarn breakage, the brakes of the apparatus are set into operation.

At the free ends of lever arms 81, 82, there is mounted a hook 86, 87, respectively, and the isolating sheet of material 80 is supported between these hooks. The sheet of material is flexible, so that it is able to conform to the curved surface of the roll 60. The flexible sheet of material is, for example, a cloth, a foil, a mat or the like. It should have sufficient heat resistance to bear the temperature of roll 60, which is up to 200° C. On the other hand, it should have sufficient insulating properties to prevent the flow of heat form roll 60 to the warp, or to at least essentially impede the flow of heat. In case of yarn breakage or upon putting the brakes into operation, the motors 85 are operated for a short time, until the leading edge 88 of the sheet of material reaches the nip formed between the surface of the roll 60 and the warp. There it is clamped between the surface of the roll and the warp, and it is then transported by the roll 60 or the warp 3.

It should be noted that the hooks 86 and 87 are positioned outside the length of the roll, and essentially on the same radius as that of the roll 60. The length 89 of the sheet of material 80 is such that is essentially identical with the running length of the yarns extending from the application of the brakes and to reaching a standstill (i.e. the braking distance). That means that in case of yarn breakage and upon application of the brakes, lever arms 81, 82 move the sheet of material 80 from the illustrated non-operative position and so that the leading edge 88 moves into the nip between the surface of the roll 60 and the warp 3. Here the sheet of material is clamped and then wrapped around the roll, so that it completely covers that part of the surface which is in contact with the warp. Furthermore, the length should be such that when restarting the apparatus, the heating of the warp, i.e. the direct heat-conducting contact between roll 60 and warp, is started again at a suitable point of time. It may be useful, if the length of the sheet of material is greater than the length of the yarn between the application of the brakes and reaching a standstill (braking distance). Preferably, however, the length of the sheet of material corresponds to this braking distance.

Figure 7A:
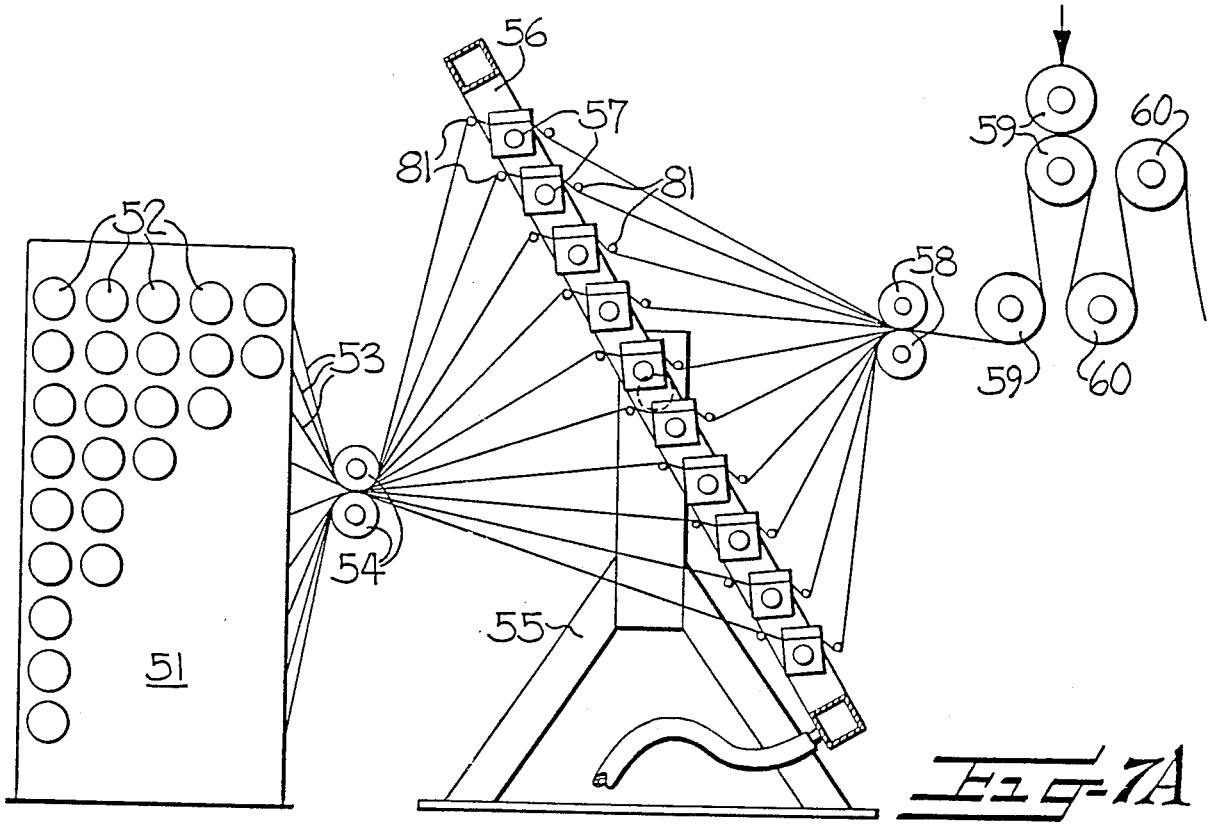
FIGS. 7A and 7B illustrate an apparatus for drawing and heat treating a warp sheet of yarns in accordance with still another embodiment of the invention.
Figure 7B:
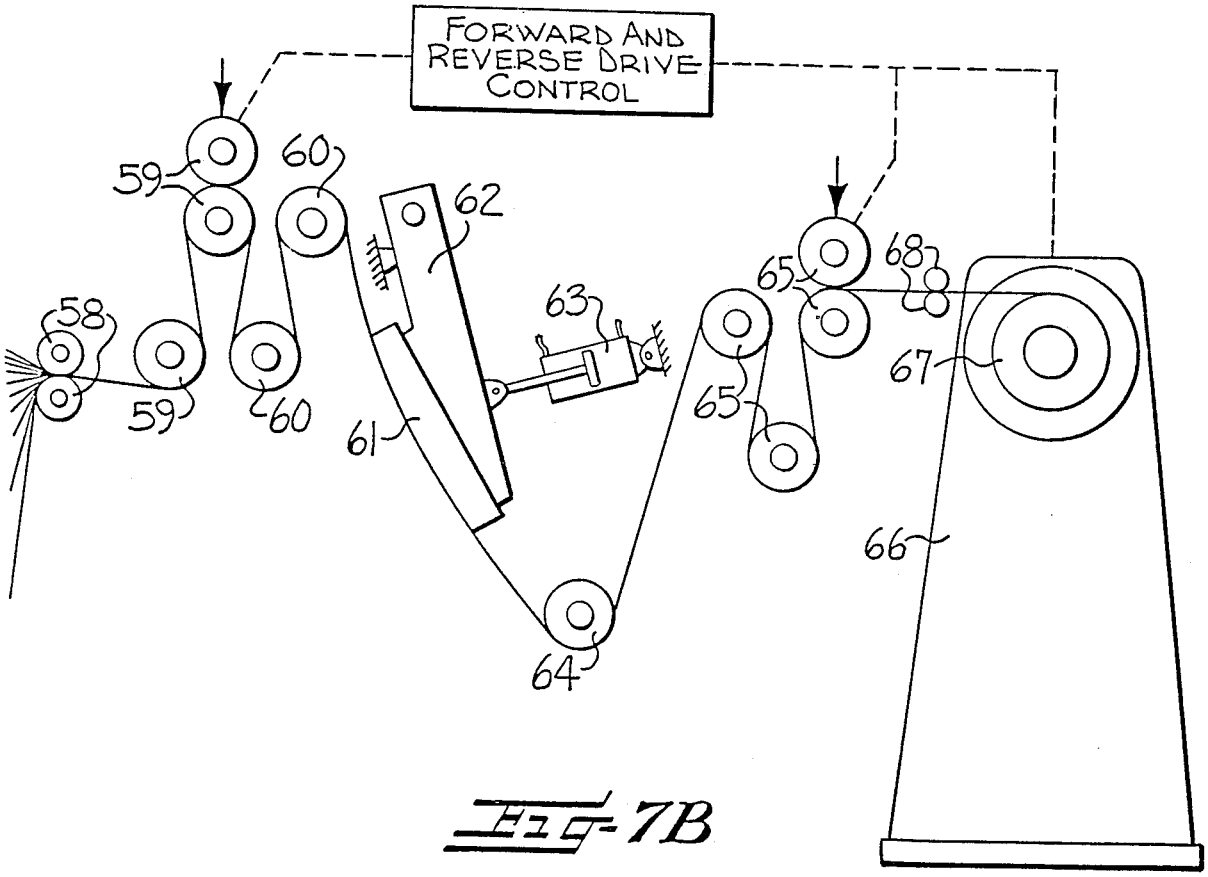

It can be seen that a flexible cover of the described type may also be used with rolls which are contacted by the warp sheet which loops around the bottom of the roll, such as is the case with the second roll 60 shown in FIGS. 7A and 7B. In this case, the flexible sheet of material hangs at the lever arms 81, 82. By moving the levers downwardly, the leading edge which is opposite the edge which is held by the lever arm falls by its gravity into the nip between the warp 3 and the surface of the roll. The sheet is then clamped and transported to cover the surface of the roll. Upon restarting the apparatus, the sheet of material is transported by the roller, until it leaves the gap and the lever arms 81, 82 are moved without being driven by their motors 85.

A further embodiment of an apparatus for processing a sheet of yarns in accordance with the present invention is illustrated in FIGS. 7A and 7B. As illustrated, a creel 51 is provided which accommodates a plurality of feed yarn packages 52, such as one thousand such packages. The yarns 53 are withdrawn from the packages via suitable yarn guides, tensioners, and yarn detectors (not shown). The yarns are withdrawn by a first pair of rolls 54 and subsequently fanned into groups of yarns, with each group then being guided through elongate air jet beams 57. The beams 57 each comprise an elongate hollow rectangular section, and they are supported by a frame 55, 56 so as to be disposed in horizontal, vertically spaced apart rows. Each beam includes an air passageway extending horizontally through its hollow section, and a plurality of yarn ducts which extend transversely to the longitudinal direction of the beam and which are aligned in a longitudinally spaced apart relation. Also, an air jet aperture communicates between the central air passageway of the beam section and each yarn duct for providing an impinging airstream upon respective ones of the yarns. The advancing yarns are thereby entangled by the air jet, so as to improve the yarn cohesion, as well as improve the smooth running properties and stretchability of the yarn. A further description of a beam of this type may be obtained from the commonly owned U.S. Pat. No. 4,592,119, and entitled Air Jet Yarn Entangling Apparatus.

Each air jet beam 57 is preceeded and followed by a guide bar 81, which is suitably mounted to the associated beam. Subsequent to the air jet entanglement, all of the yarns are brought together into one plane, by means of the two guide rolls 58. The yarns are then withdrawn by the feed rolls 59 of the drawing system. Heated rolls 60 follow the feed rolls 59, and the rolls 60 are heated to about 90 degrees C. in the case of polyester yarns. The yarns then travel over a hot plate 61 upon which they are heated to about 120 degrees C. or more. The hot plate 61 is pivotally mounted on a support bracket 62, and the plate is adapted to be removed from the sheet of yearns by a pneumatic cylinder piston assembly 63. The assembly 63 may be controlled as a function of yarn detectors (not shown). A deflecting roll 64 is mounted downstream of the plate 61, and is followed by delivery rolls 65. The circumferential speed of the delivery rolls 65 is greater than the circumferential speed of the feed rolls 59, by the draw ratio. The sheet of yarns is then guided via a reed or comb 68 to the warp beam 67 on the beam winder 66.

The present invention provides that covers as per FIGS. 3–6 may be provided for thermally isolating the heated rolls 60 from the warp sheet during a non-advance or standstill of the sheet, or that the rolls 60 may be heated with a fluid, and that valve means is provided through which the heated fluid may be rapidly exchanged with an unheated fluid. In this latter case, the valve means is preferably operatively connected with the yarn monitoring system of the drawing apparatus. Water is usually a suitable hot fluid, since temperatures up to 100 degrees C. are usually sufficient. Water is also suitable as the cooling fluid, with cool being here understood to mean a temperature at which the yarns are not subject to damage.

It should also be noted that the surface speed of the rolls 60 may be adjusted independently of that of the rolls 59 and 65, respectively, which is known per se from the drawing technology for man made filament yarns, and in particular polyester filament yarns.

Figure 8:
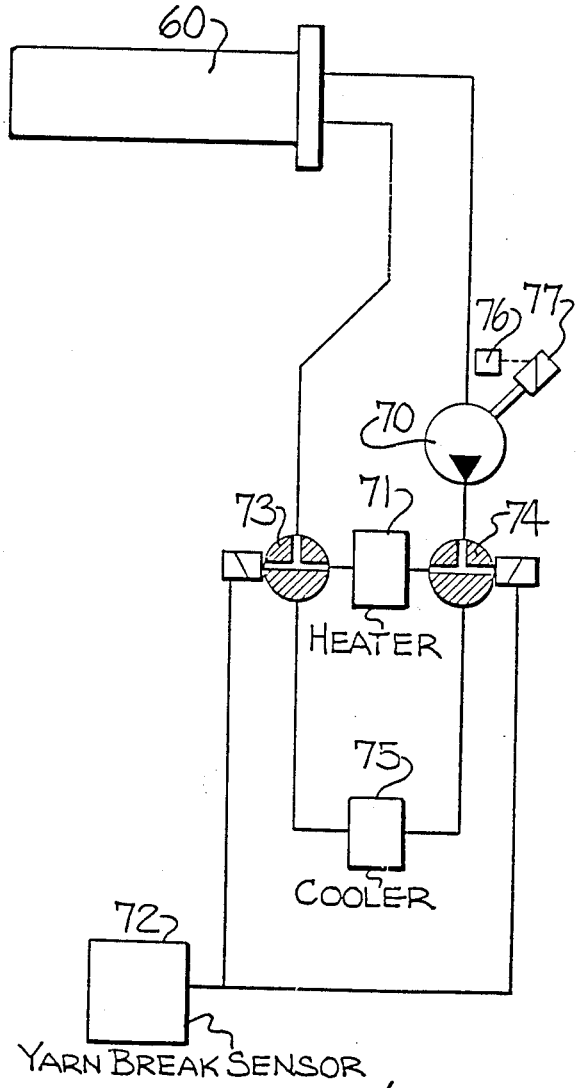
FIG. 8 is a schematic view of a heated roll, with a heating and cooling circuit in accordance with still another embodiment of the invention.

FIG. 8 illustrates the heating and cooling circuit for the rolls 60 of the embodiment of FIGS. 7A and 7B. The rolls 60 are hollow, and are connected to a fluid conduit via conventional slip ring couplings. The heating circuit includes a pump 70, and upon operation of the pump 70, a heating fluid circulates through the heater 71 which holds the fluid at a predetermined temperature. Upon a break of even one of the yarns of the sheet 10 being detected by the yarn sensor 72, an output signal is generated causing the three way valves 73 and 74 to be reversed so that the heater is disconnected from the fluid circuit and the cooler 75 is connected to the circuit it its place. The cooler 75 may be an active cooler, however under certain circumstances it may comprise a sufficiently large fluid container in which the fluid is held at room temperature. For this purpose, a heat exchanger may be provided if necessary. The fluid is then transported from the cooling container or cooler 75 into the interior of the hollow roll 60. In so doing, it will often suffice that the roll 60 receives a single filling of the cooled fluid, however, this depends on the mass and thermal characteristics of the roll 60, as well as its temperature, the temperature of the fluid pumped from the cooling container, and also the desired temperature decrease.

Instead of replacing the heated fluid of the roll 60 with a single filling of cooling fluid, it is also possible that the cooling fluid may be continuously circulated. In this case, a temperature sensor 76 may be positioned in the circuit upstream of the pump 70, with the sensor 76 being designed to disconnect the drive 77 of the pump 70 upon a desired temperature having been reached.

Referring again to FIG. 7B, it will be recalled that the rolls 60 of the feed system and the plate 61 are heated. Also, it will be understood that, depending upon the degree of the spun orientation of the advancing yarns, a change in length, i.e. flow, will occur between the last roll 60 and the hot plate 61. It may also be assumed that the flow zone will extend to the hot plate 61. As a result, in the event of a shut down, an undrawn length of the yarn will rest upon the heated roll 60 and the initial portion of the hot plate 61. For this reason, the apparatus may be temporarily operated in the reverse direction after a shut down of the apparatus, with the transmission ratio between all rolls 59, 60, 65 being changed to one to one. This reverse movement continues until no undrawn yarn is left in contact with any heating means. When the rolls 60 are not cooled, the return movement should thus continue until the flow zone has arrived at a point upstream of the rolls 60. If however the rolls 60 are cooled in the manner described above, the return movement needs to proceed only so far that the flow zone comes to a position between the rolls 60 and the entry side of the heating plate 61, which means that a shorter return distance will be adequate. When proceeding in this manner, the cooling of the rolls and/or the lifting of the hot plate from the yarns may be avoided. However, it should be noted that this procedure is applicable only when the drawn yarn material can withstand the temperatures required for the drawing, without damage during the anticipated time of the breakdown. The ability to withstand such temperature depends on the particular yarn composition. Likewise, the level of the temperature is dependent on the yarn composition, as well as the other drawing parameters and the desired end product. It has been found that the described method is easily applicable to and advantageous with the processing of polyethylene therephthalate multifilament yarns which have been spun at a delivery speed of more than 3500 m/min, which imparts a relatively high spun orientation.

To restart the apparatus after correction of the breakdown, the rolls 59, 60 and 65 first start to rotate at a transmission ratio of one to one until the yarns, i.e. the flow zone, has again reached the position at which the shut down occurred. The number of forward revolutions of the rolls 59, 60, 65 at a transmission ratio of one to one thus corresponds to the number of the rearward revolutions previously carried out at a transmission ratio of one to one. It should be noted also that the warp beam must perform these backward and forward revolutions, and it is necessary to adapt its speed to the permissible yarn tension.

In the drawings and specification, there has been set forth preferred embodiments of the invention, and although specific terms are employed, they are used in a generic and descriptive sense only, and not for purposes of limitation.

That which we claim is:

1. An apparatus for processing a warp sheet of yarns comprising means for advancing the warp sheet along a path of travel while drawing the warp sheet, heating means positioned along the path of travel for applying heat to the advancing warp sheet, said heating means comprising a pair of heated rolls, and means mounting said rolls for movement with respect to each other between a first position wherein the warp sheet is in contact with the rolls and the warp sheet is deflected into an S or Z configuration thereby, and a second position wherein a warp sheet is substantially out of contact with the rolls and one roll is positioned above the warp sheet and the other of the rolls is positioned below the warp sheet, control means for selectively terminating the advance of the warp sheet upon a yarn break or apparatus stoppage, and including drive means for selectively moving said pair of rolls from said first position to said second position upon the termination of the advance, and moving said pair of rolls from said second position back to said first position upon re-starting of the advance, and tension controlling means for maintaining the overall tension in the warp sheet substantially uniform during movement of said rolls between said first and second positions.

2. The apparatus as defined in claim 1 wherein said means mounting said pair of heated rolls comprises a first pivotal lever arm which is adapted to pivot about an axis which extends transversely across the warp sheet and generally parallel to the axes of the heated rolls, and with said rolls being mounted at respective opposite ends of said first pivotal lever arm, and wherein said drive means moves said pair of rolls between said first and second positions by pivoting said first lever arm about said axis.

3. The apparatus as defined in claim 2 wherein said tension controlling means includes a pair of unheated rolls, with said unheated rolls being mounted at the respective opposite ends of a second pivotal lever arm which is adapted to pivot about an axis which is parallel to that of said first pivotal lever arm, and said drive means includes means for selectively pivoting said second lever arm between a first position wherein one of the unheated rolls is positioned above the warp sheet and the other of the unheated rolls is positioned below the warp sheet, and a second position wherein the unheated rolls are in contact with the warp sheet and deflect the path of travel into an S or Z configuration.

4. The apparatus as defined in claim 3 wherein said control means further comprises means for coordinating the movement of said first and second lever arms such that only the heated rolls are in substantial contact with the warp sheet during the advance of the sheet, and only the unheated rolls are in substantial contact with the warp sheet during a termination of the advance, and such that the overall tension in the warp sheet remains substantially uniform during the advance and the termination of the advance.

5. The apparatus as defined in claim 1 wherein said means for advancing the warp sheet along a path of travel includes upstream delivery roll means and downstream delivery roll means, and wherein said pair of heated rolls is mounted between said upstream and downstream delivery roll means, and said tension controlling means includes at least one unheated roll mounted between said upstream and downstream delivery roll means and for back and forth movement along a path generally transverse to a line extending between said upstream and downstream delivery roll means.

6. The apparatus as defined in claim 5 wherein said one unheated roll and said pair of heated rolls are interconnected for concurrent movement by said drive means, and such that the length of the path of travel of the warp sheet between said upstream and downstream delivery roll means is the same in the first and second positions of said pair of rolls.

7. An apparatus for processing a warp sheet of yarns comprising means for advancing the warp sheet along a path of travel while drawing the warp sheet, and including upstream delivery roll means and downstream delivery roll means, heating means positioned along the path of travel and between said upstream and downstream delivery roll means for applying heat to the advancing warp sheet, said heating means comprising a pair of heated rolls, and means mounting said rolls for movement with respect to each other between a first position wherein the warp sheet is in contact with the rolls and the warp sheet is deflected into an S or Z configuration thereby, and a second position wherein the warp sheet is substantially out of contact with the rolls and one roll is positioned above the warp sheet and the other of the rolls is positioned below the warp sheet, control means for selectively terminating the advance of the warp sheet upon a yarn break or apparatus stoppage, and including drive means for selectively moving said pair of rolls from said first position to said second position upon the termination of the advance, and moving said pair of rolls from said second position back to said first position upon re-starting of the advance, and length controlling means for maintaining the overall length of the path of travel of the warp sheet between said upstream and downstream delivery roll means substantially uniform during movement of said pair of heated rolls between said first and second positions.

8. The apparatus as defined in claim 7 wherein said length controlling means includes at least one unheated roll mounted between said upstream and downstream delivery roll means and for back and forth movement along a path generally transverse to a line extending between said upstream and downstream delivery roll means.

9. The apparatus as defined in claim 8 wherein said one unheated roll and said pair of heated rolls are interconnected for concurrent movement by said drive means.

10. The apparatus as defined in claim 7 wherein said means mounting said pair of heated rolls comprises a first pivotal lever arm which is adapted to pivot about an axis which extends transversely across the warp sheet and generally parallel to the axes of the heated rolls, and with said rolls being mounted at respective opposite ends of said first pivotal lever arm, and wherein said drive means moves said pair of rolls between said first and second positions by pivoting said first lever arm about said axis.

11. The apparatus as defined in claim 10 wherein said length controlling means includes a pair of unheated rolls, with said unheated rolls being mounted at the respective opposite ends of a second pivotal lever arm which is adapted to pivot about an axis which is parallel to that of said first pivotal lever arm, and said drive means includes means for selectively pivoting said second lever arm between a first position wherein one of the unheated rolls is positioned above the warp sheet and the other of the unheated rolls is positioned below the warp sheet, and a second position wherein the unheated rolls are in contact with the warp sheet and deflect the path of travel thereof into an S or Z configuration.

* * * * *